US008247971B1

(12) United States Patent
Bard et al.

(10) Patent No.: US 8,247,971 B1
(45) Date of Patent: Aug. 21, 2012

(54) RESISTIVELY HEATED SMALL PLANAR FILAMENT

(75) Inventors: Erik C. Bard, Lehi, UT (US); Sterling W. Cornaby, Springville, UT (US)

(73) Assignee: Moxtek, Inc., Orem, UT (US)

( * ) Notice: Subject to any disclaimer, the term of this patent is extended or adjusted under 35 U.S.C. 154(b) by 0 days.

(21) Appl. No.: 13/209,862

(22) Filed: Aug. 15, 2011

Related U.S. Application Data

(63) Continuation-in-part of application No. 12/407,457, filed on Mar. 19, 2009, now abandoned.

(51) Int. Cl.
*H01J 17/04* (2012.01)

(52) U.S. Cl. ..... 313/631; 313/491; 313/310

(58) Field of Classification Search ..... 313/631, 313/491, 310
See application file for complete search history.

(56) References Cited

U.S. PATENT DOCUMENTS

| | | | |
|---|---|---|---|
| 1,276,706 | A | 5/1918 | Snook et al. |
| 1,881,448 | A | 10/1932 | Forde et al. |
| 1,946,288 | A | 2/1934 | Kearsley |
| 2,291,948 | A | 8/1942 | Cassen |
| 2,316,214 | A | 4/1943 | Atlee et al. |
| 2,329,318 | A | 9/1943 | Atlee et al. |
| 2,340,363 | A | 2/1944 | Atlee et al. |
| 2,502,070 | A | 3/1950 | Atlee et al. |
| 2,663,812 | A | 3/1950 | Jamison et al. |
| 2,683,223 | A | 7/1954 | Hosemann |
| 2,952,790 | A | 9/1960 | Steen |
| 3,218,559 | A | 11/1965 | Applebaum |
| 3,356,559 | A | 12/1967 | Mohn et al. |
| 3,397,337 | A | 8/1968 | Denholm |
| 3,434,062 | A | 3/1969 | Cox |
| 3,358,368 | A | 11/1970 | Oess |
| 3,665,236 | A | 5/1972 | Gaines et al. |
| 3,679,927 | A | 7/1972 | Kirkendall |
| 3,691,417 | A | 9/1972 | Gralenski |
| 3,751,701 | A | 8/1973 | Gralenski et al. |
| 3,801,847 | A | 4/1974 | Dietz |
| 3,828,190 | A | 8/1974 | Dahlin et al. |
| 3,851,266 | A | 11/1974 | Conway |
| 3,872,287 | A | 3/1975 | Kooman |
| 3,882,339 | A | 5/1975 | Rate et al. |
| 3,894,219 | A | 7/1975 | Weigel |
| 3,962,583 | A | 6/1976 | Holland et al. |

(Continued)

FOREIGN PATENT DOCUMENTS

| | | |
|---|---|---|
| DE | 10 30 936 | 5/1958 |

(Continued)

OTHER PUBLICATIONS

PCT Application PCT/US2011/044168; filed Jul. 15, 2011; Dongbing Wang; International Search Report mailed Mar. 28, 2012.

(Continued)

*Primary Examiner* — Vip Patel
(74) *Attorney, Agent, or Firm* — Thorpe North & Western LLP

(57) ABSTRACT

A planar filament comprising two bonding pads and a non-linear filament connected between the two bonding pads. The planar filament may be wider in the center to increase filament life. The planar filament can form a double spiral-serpentine shape. The planar filament may be mounted on a substrate for easier handling and placement. Voltage can be used to create an electrical current through the filament, and can result in the emission of electrons from the filament. The planar filament can be utilized in an x-ray tube.

20 Claims, 7 Drawing Sheets

U.S. PATENT DOCUMENTS

| | | | |
|---|---|---|---|
| 3,970,884 | A | 7/1976 | Golden |
| 4,007,375 | A | 2/1977 | Albert |
| 4,075,526 | A | 2/1978 | Grubis |
| 4,160,311 | A | 7/1979 | Ronde et al. |
| 4,163,900 | A | 8/1979 | Warren et al. |
| 4,178,509 | A | 12/1979 | More et al. |
| 4,184,097 | A | 1/1980 | Auge |
| 4,250,127 | A | 2/1981 | Warren et al. |
| 4,293,373 | A | 10/1981 | Greenwood |
| 4,368,538 | A | 1/1983 | McCorkle |
| 4,393,127 | A | 7/1983 | Greschner et al. |
| 4,421,986 | A | 12/1983 | Friauf et al. |
| 4,443,293 | A | 4/1984 | Mallon et al. |
| 4,463,338 | A | 7/1984 | Utner et al. |
| 4,504,895 | A | 3/1985 | Steigerwald |
| 4,521,902 | A | 6/1985 | Peugeot |
| 4,532,150 | A | 7/1985 | Endo et al. |
| 4,573,186 | A | 2/1986 | Reinhold |
| 4,576,679 | A | 3/1986 | White |
| 4,584,056 | A | 4/1986 | Perret et al. |
| 4,591,756 | A | 5/1986 | Avnery |
| 4,608,326 | A | 8/1986 | Neukermans et al. |
| 4,645,977 | A | 2/1987 | Kurokawa et al. |
| 4,675,525 | A | 6/1987 | Amingual et al. |
| 4,679,219 | A | 7/1987 | Ozaki |
| 4,688,241 | A | 8/1987 | Peugeot |
| 4,696,994 | A | 9/1987 | Nakajima |
| 4,705,540 | A | 11/1987 | Hayes |
| 4,777,642 | A | 10/1988 | Ono |
| 4,797,907 | A | 1/1989 | Anderton |
| 4,818,806 | A | 4/1989 | Kunimune et al. |
| 4,819,260 | A | 4/1989 | Haberrecker |
| 4,862,490 | A | 8/1989 | Karnezos et al. |
| 4,870,671 | A | 9/1989 | Hershyn |
| 4,876,330 | A | 10/1989 | Higashi et al. |
| 4,878,866 | A | 11/1989 | Mori et al. |
| 4,885,055 | A | 12/1989 | Woodbury et al. |
| 4,891,831 | A | 1/1990 | Tanaka et al. |
| 4,933,557 | A | 6/1990 | Perkins |
| 4,939,763 | A | 7/1990 | Pinneo et al. |
| 4,957,773 | A | 9/1990 | Spencer et al. |
| 4,960,486 | A | 10/1990 | Perkins et al. |
| 4,969,173 | A | 11/1990 | Valkonet |
| 4,979,198 | A | 12/1990 | Malcolm et al. |
| 4,979,199 | A | 12/1990 | Cueman et al. |
| 5,010,562 | A | 4/1991 | Hernandez et al. |
| 5,063,324 | A | 11/1991 | Grunwald |
| 5,066,300 | A | 11/1991 | Isaacson et al. |
| 5,077,771 | A | 12/1991 | Skillicorn et al. |
| 5,077,777 | A | 12/1991 | Daly |
| 5,090,046 | A | 2/1992 | Friel |
| 5,105,456 | A | 4/1992 | Rand et al. |
| 5,117,829 | A | 6/1992 | Miller et al. |
| 5,153,900 | A | 10/1992 | Nomikos et al. |
| 5,161,179 | A | 11/1992 | Suzuki et al. |
| 5,173,612 | A | 12/1992 | Imai et al. |
| 5,178,140 | A | 1/1993 | Ibrahim |
| 5,196,283 | A | 3/1993 | Ikeda et al. |
| 5,217,817 | A | 6/1993 | Verspui et al. |
| 5,226,067 | A | 7/1993 | Allred et al. |
| RE34,421 | E | 10/1993 | Parker et al. |
| 5,258,091 | A | 11/1993 | Imai et al. |
| 5,267,294 | A | 11/1993 | Kuroda et al. |
| 5,302,523 | A | 4/1994 | Coffee et al. |
| 5,343,112 | A | 8/1994 | Wegmann |
| 5,391,958 | A | 2/1995 | Kelly |
| 5,392,042 | A | 2/1995 | Pellon |
| 5,400,385 | A | 3/1995 | Blake et al. |
| 5,422,926 | A | 6/1995 | Smith |
| 5,428,658 | A | 6/1995 | Oettinger et al. |
| 5,432,003 | A | 7/1995 | Plano et al. |
| 5,469,429 | A | 11/1995 | Yamazaki et al. |
| 5,469,490 | A | 11/1995 | Golden et al. |
| 5,478,266 | A | 12/1995 | Kelly |
| 5,521,851 | A | 5/1996 | Wei et al. |
| 5,524,133 | A | 6/1996 | Neale et al. |
| RE35,383 | E | 11/1996 | Miller et al. |
| 5,571,616 | A | 11/1996 | Phillips et al. |
| 5,578,360 | A | 11/1996 | Viitanen |
| 5,602,507 | A | 2/1997 | Suzuki |
| 5,607,723 | A | 3/1997 | Plano et al. |
| 5,621,780 | A | 4/1997 | Smith et al. |
| 5,627,871 | A | 5/1997 | Wang |
| 5,631,943 | A | 5/1997 | Miles |
| 5,673,044 | A | 9/1997 | Pellon |
| 5,680,433 | A | 10/1997 | Jensen |
| 5,682,412 | A | 10/1997 | Skillicorn et al. |
| 5,696,808 | A | 12/1997 | Lenz |
| 5,706,354 | A | 1/1998 | Stroehlein |
| 5,729,583 | A | 3/1998 | Tang et al. |
| 5,774,522 | A | 6/1998 | Warburton |
| 5,812,632 | A | 9/1998 | Schardt et al. |
| 5,835,561 | A | 11/1998 | Moorman et al. |
| 5,870,051 | A | 2/1999 | Warburton |
| 5,898,754 | A | 4/1999 | Gorzen |
| 5,907,595 | A | 5/1999 | Sommerer |
| 6,002,202 | A | 12/1999 | Meyer et al. |
| 6,005,918 | A | 12/1999 | Harris et al. |
| 6,044,130 | A | 3/2000 | Inazura et al. |
| 6,062,931 | A | 5/2000 | Chuang et al. |
| 6,063,629 | A | 5/2000 | Knoblauch |
| 6,069,278 | A | 5/2000 | Chuang |
| 6,073,484 | A | 6/2000 | Miller et al. |
| 6,075,839 | A | 6/2000 | Treseder |
| 6,097,790 | A | 8/2000 | Hasegawa et al. |
| 6,129,901 | A | 10/2000 | Moskovits et al. |
| 6,133,401 | A | 10/2000 | Jensen |
| 6,134,300 | A | 10/2000 | Trebes et al. |
| 6,184,333 | B1 | 2/2001 | Gray |
| 6,205,200 | B1 | 3/2001 | Boyer et al. |
| 6,277,318 | B1 | 8/2001 | Bower |
| 6,282,263 | B1 | 8/2001 | Arndt et al. |
| 6,288,209 | B1 | 9/2001 | Jensen |
| 6,307,008 | B1 | 10/2001 | Lee et al. |
| 6,320,019 | B1 | 11/2001 | Lee et al. |
| 6,351,520 | B1 | 2/2002 | Inazaru |
| 6,385,294 | B2 | 5/2002 | Suzuki et al. |
| 6,388,359 | B1 | 5/2002 | Duelli et al. |
| 6,438,207 | B1 | 8/2002 | Chidester et al. |
| 6,477,235 | B2 | 11/2002 | Chornenky et al. |
| 6,487,272 | B1 | 11/2002 | Kutsuzawa |
| 6,487,273 | B1 | 11/2002 | Takenaka et al. |
| 6,494,618 | B1 | 12/2002 | Moulton |
| 6,546,077 | B2 | 4/2003 | Chornenky et al. |
| 6,567,500 | B2 | 5/2003 | Rother |
| 6,645,757 | B1 | 11/2003 | Okandan et al. |
| 6,646,366 | B2 | 11/2003 | Hell et al. |
| 6,658,085 | B2 | 12/2003 | Sklebitz et al. |
| 6,661,876 | B2 | 12/2003 | Turner et al. |
| 6,740,874 | B2 | 5/2004 | Doring |
| 6,778,633 | B1 | 8/2004 | Loxley et al. |
| 6,799,075 | B1 | 9/2004 | Chornenky et al. |
| 6,803,570 | B1 | 10/2004 | Bryson, III et al. |
| 6,803,571 | B1 | 10/2004 | Mankos et al. |
| 6,816,573 | B2 | 11/2004 | Hirano et al. |
| 6,819,741 | B2 | 11/2004 | Chidester |
| 6,838,297 | B2 | 1/2005 | Iwasaki |
| 6,852,365 | B2 | 2/2005 | Smart et al. |
| 6,866,801 | B1 | 3/2005 | Mau et al. |
| 6,876,724 | B2 | 4/2005 | Zhou |
| 6,900,580 | B2 | 5/2005 | Dai et al. |
| 6,956,706 | B2 | 10/2005 | Brandon |
| 6,962,782 | B1 | 11/2005 | Livache et al. |
| 6,976,953 | B1 | 12/2005 | Pelc |
| 6,987,835 | B2 | 1/2006 | Lovoi |
| 7,035,379 | B2 | 4/2006 | Turner et al. |
| 7,046,767 | B2 | 5/2006 | Okada et al. |
| 7,049,735 | B2 | 5/2006 | Ohkubo et al. |
| 7,050,539 | B2 | 5/2006 | Loef et al. |
| 7,075,699 | B2 | 7/2006 | Oldham et al. |
| 7,085,354 | B2 | 8/2006 | Kanagami |
| 7,108,841 | B2 | 9/2006 | Smalley |
| 7,110,498 | B2 | 9/2006 | Yamada |
| 7,130,380 | B2 | 10/2006 | Lovoi et al. |
| 7,130,381 | B2 | 10/2006 | Lovoi et al. |
| 7,189,430 | B2 | 3/2007 | Ajayan et al. |
| 7,203,283 | B1 | 4/2007 | Puusaari |

| | | | |
|---|---|---|---|
| 7,206,381 | B2 | 4/2007 | Shimono et al. |
| 7,215,741 | B2 | 5/2007 | Ukita |
| 7,224,769 | B2 | 5/2007 | Turner |
| 7,233,071 | B2 | 6/2007 | Furukawa et al. |
| 7,233,647 | B2 | 6/2007 | Turner et al. |
| 7,286,642 | B2 | 10/2007 | Ishikawa et al. |
| 7,305,066 | B2 | 12/2007 | Ukita |
| 7,317,784 | B2 | 1/2008 | Durst et al. |
| 7,358,593 | B2 | 4/2008 | Smith et al. |
| 7,382,862 | B2 | 6/2008 | Bard et al. |
| 7,399,794 | B2 | 7/2008 | Harmon et al. |
| 7,410,603 | B2 | 8/2008 | Noguchi et al. |
| 7,428,298 | B2 | 9/2008 | Bard et al. |
| 7,448,801 | B2 | 11/2008 | Oettinger et al. |
| 7,448,802 | B2 | 11/2008 | Oettinger et al. |
| 7,486,774 | B2 | 2/2009 | Cain |
| 7,526,068 | B2 | 4/2009 | Dinsmore |
| 7,529,345 | B2 | 5/2009 | Bard et al. |
| 7,618,906 | B2 | 11/2009 | Meilahti |
| 7,634,052 | B2 | 12/2009 | Grodzins et al. |
| 7,649,980 | B2 | 1/2010 | Aoki et al. |
| 7,650,050 | B2 | 1/2010 | Haffner et al. |
| 7,657,002 | B2 | 2/2010 | Burke et al. |
| 7,675,444 | B1 | 3/2010 | Smith et al. |
| 7,680,652 | B2 | 3/2010 | Giesbrecht et al. |
| 7,693,265 | B2 | 4/2010 | Hauttmann et al. |
| 7,709,820 | B2 | 5/2010 | Decker et al. |
| 3,741,797 | A1 | 6/2010 | Chavasse, Jr. et al. |
| 7,737,424 | B2 | 6/2010 | Xu et al. |
| 7,756,251 | B2 | 7/2010 | Davis et al. |
| 7,983,394 | B2 | 7/2011 | Kozaczek |
| 2002/0075999 | A1 | 6/2002 | Rother |
| 2002/0094064 | A1 | 7/2002 | Zhou |
| 2003/0096104 | A1 | 5/2003 | Tobita et al. |
| 2003/0117770 | A1 | 6/2003 | Montgomery et al. |
| 2003/0152700 | A1 | 8/2003 | Asmussen et al. |
| 2003/0165418 | A1 | 9/2003 | Ajayan et al. |
| 2004/0076260 | A1 | 4/2004 | Charles, Jr. et al. |
| 2005/0018817 | A1 | 1/2005 | Oettinger et al. |
| 2005/0141669 | A1 | 6/2005 | Shimono et al. |
| 2005/0207537 | A1 | 9/2005 | Ukita |
| 2006/0073682 | A1 | 4/2006 | Furukawa et al. |
| 2006/0098778 | A1 | 5/2006 | Oettinger et al. |
| 2006/0210020 | A1 | 9/2006 | Takahashi et al. |
| 2006/0233307 | A1 | 10/2006 | Dinsmore |
| 2006/0269048 | A1 | 11/2006 | Cain |
| 2006/0280289 | A1 | 12/2006 | Hanington et al. |
| 2007/0025516 | A1 | 2/2007 | Bard et al. |
| 2007/0087436 | A1 | 4/2007 | Miyawaki et al. |
| 2007/0111617 | A1 | 5/2007 | Meilahti |
| 2007/0133921 | A1 | 6/2007 | Haffner et al. |
| 2007/0142781 | A1 | 6/2007 | Sayre |
| 2007/0165780 | A1 | 7/2007 | Durst et al. |
| 2007/0172104 | A1 | 7/2007 | Nishide |
| 2007/0176319 | A1 | 8/2007 | Thostenson et al. |
| 2007/0183576 | A1 | 8/2007 | Burke et al. |
| 2007/0217574 | A1 | 9/2007 | Beyerlein |
| 2008/0199399 | A1 | 8/2008 | Chen et al. |
| 2008/0296479 | A1 | 12/2008 | Anderson et al. |
| 2008/0296518 | A1 | 12/2008 | Xu et al. |
| 2008/0317982 | A1 | 12/2008 | Hecht et al. |
| 2009/0085426 | A1 | 4/2009 | Davis et al. |
| 2009/0086923 | A1 | 4/2009 | Davis et al. |
| 2009/0213914 | A1 | 8/2009 | Dong et al. |
| 2009/0243028 | A1 | 10/2009 | Dong et al. |
| 2010/0096595 | A1 | 4/2010 | Prud'homme et al. |
| 2010/0098216 | A1 | 4/2010 | Dobson |
| 2010/0126660 | A1 | 5/2010 | O'Hara |
| 2010/0140497 | A1 | 6/2010 | Damiano, Jr. et al. |
| 2010/0189225 | A1 | 7/2010 | Ernest et al. |
| 2010/0239828 | A1 | 9/2010 | Cornaby et al. |
| 2010/0243895 | A1 | 9/2010 | Xu |
| 2010/0248343 | A1 | 9/2010 | Aten et al. |
| 2010/0285271 | A1 | 11/2010 | Davis et al. |
| 2010/0323419 | A1 | 12/2010 | Aten et al. |
| 2011/0017921 | A1 | 1/2011 | Jiang et al. |
| 2011/0121179 | A1 | 5/2011 | Liddiard |

FOREIGN PATENT DOCUMENTS

| | | |
|---|---|---|
| DE | 44 30 623 | 3/1996 |
| DE | 19818057 | 11/1999 |
| EP | 0 297 808 | 1/1989 |
| EP | 0330456 | 8/1989 |
| EP | 0400655 | 5/1990 |
| EP | 0676772 | 3/1995 |
| GB | 1252290 | 11/1971 |
| JP | 57 082954 | 8/1982 |
| JP | 3170673 | 7/1991 |
| JP | 4171700 | 6/1992 |
| JP | 05066300 | 3/1993 |
| JP | 5066300 | 3/1993 |
| JP | 5135722 | 6/1993 |
| JP | 06 119893 | 7/1994 |
| JP | 6289145 | 10/1994 |
| JP | 6343478 | 12/1994 |
| JP | 08315783 | 11/1996 |
| JP | 2003/007237 | 1/2003 |
| JP | 2003/088383 | 3/2003 |
| JP | 2003510236 | 3/2003 |
| JP | 2003211396 | 7/2003 |
| JP | 2006297549 | 11/2008 |
| KR | 1020050107094 | 11/2005 |
| WO | WO9619738 | 6/1996 |
| WO | WO 99/65821 | 12/1999 |
| WO | WO 00/09443 | 2/2000 |
| WO | WO 00/17102 | 3/2000 |
| WO | WO 03/076951 | 9/2003 |
| WO | WO2008/052002 | 5/2008 |
| WO | WO 2009/009610 | 1/2009 |
| WO | WO 2009/045915 | 4/2009 |
| WO | WO 2009/085351 | 7/2009 |
| WO | WO 2010/107600 | 9/2010 |

OTHER PUBLICATIONS

U.S. Appl. No. 12/783,707, filed May 20, 2010; Steven D. Liddiard; office action issued Jun. 22, 2012.

U.S. Appl. No. 12/239,281, filed Sep. 26, 2008; Robert C. Davis; office action issued May 24, 2012.

PCT Application PCT/US2011/046371; filed Aug. 3, 2011; Steven Liddiard; International Search Report mailed Feb. 29, 2012.

Anderson et al., U.S. Appl. No. 11/756,962, filed Jun. 1, 2007.

Barkan et al., "Improved window for low-energy x-ray transmission a Hybrid design for energy-dispersive microanalysis," Sep. 1995, 2 pages, Ectroscopy 10(7).

Blanquart et al.; "XPAD, a New Read-out Pixel Chip for X-ray Counting"; IEEE Xplore; Mar. 25, 2009.

Chakrapani et al.; Capillarity-Driven Assembly of Two-Dimensional Cellular Carbon Nanotube Foams; PNAS; Mar. 23, 2004, pp. 4009-4012; vol. 101; No. 12.

Gevin et al., "IDeF-X V1.0: performances of a new CMOS multi channel analogue readout ASIC for Cd(Zn)Te detectors", IDDD, Oct. 2005, 433-437, vol. 1.

Grybos et al., "Measurements of matching and high count rate performance of multichannel ASIC for digital x-ray imaging systems", IEEE, Aug. 2007, 1207-1215, vol. 54, Issue 4.

Grybos et al., "Pole-Zero cancellation circuit with pulse pile-up tracking system for low noise charge-sensitive amplifiers", Feb. 2008, 583-590, vol. 55, Issue 1.

Hu et al.; "Carbon Nanotube Thin Films: Fabrication, Properties, and Applications"; 2010 American Chemical Society Jul. 22, 2010.

Li, Jun et al., "Bottom-up approach for carbon nanotube interconnects," Applied Physical Letters, Apr. 14, 2003, pp. 2491-2493, vol. 82 No. 15.

U.S. Appl. No. 12/352,864, filed Jan. 13, 2009; Lines.

U.S. Appl. No. 12/726,120, filed Mar. 17, 2010; Lines.

Najafi et al.; "Radiation resistant polymer-carbon nanotube nanocomposite thin films"; Department of Materials Science and Engineering . . . Nov. 21, 2004.

Nakajima et al.; "Trial use of carbon-filter-reinforced plastic as a non-Bragg window material of x-ray transmission"; Rev. Sci. Instrum 60 (7), Jul. 1989.

Nakajima et al; Trial Use of Carbon-Fiber-Reinforced Plastic as a Non-Bragg Window Material of X-Ray Transmission; Rev. Sci. Instrum.; Jul. 1989, pp. 2432-2435; vol. 60, No. 7.
Sheather, "The support of thin windows for x-ray proportional counters," Journal Phys,E., Apr. 1973, pp. 319-322, vol. 6, No. 4.
Tamura et al., "Development of ASICs for CdTe pixel and line sensors", Oct. 2005, 2023-2029, vol. 52, Issue 5.
Tien-Hui Lin et al., "An investigation on the films used as teh windows of ultra-soft X-ray counters." Acta Physica Sinica, vol. 27, No. 3, pp. 276-283, May 1978, abstract only.
U.S. Appl. No. 12/726,120, filed Mar. 17, 2010, Michael Lines.
U.S. Appl. No. 12/899,750, filed Oct. 7, 2010, Steven Liddiard.
U.S. Appl. No. 13/018,667, filed Feb. 1, 2011, Robert C. Davis.
Viitanen Veli-Pekka et al., Comparison of Ultrathin X-Ray Window Designs, presented at the Soft X-rays in the 21st Century Conference held in Provo, Utah Feb. 10-13, 1993, pp. 182-190.
Wagner et al, "Effects of Scatter in Dual-Energy Imaging: An Alternative Analysis"; IEEE; Sep. 1989, vol. 8 No. 3.
Wagner et al., "Effects of scatter in dual-energy imaging: an alternative analysis"; Sep. 1989, 236-244, vol. 8, Issue 3.
Wang et al; "Highly oriented carbon nanotube papers made of aligned carbon nanotubes"; Tsinghua-Foxconn Nanotechnology Research Center and Department of Physics; Published Jan. 31, 2008.
Wu, et al.; "Mechanical properties and thermo-gravimetric analysis of PBO thin films"; Advanced Materials Laboratory, Institue of Electro-Optical Engineering; Apr. 30, 2006.
Xie et al.; "Dispersion and alignment of carbon nanotubes in polymer matrix: A review"; Center for Advanced Materials Technology; Apr. 20, 2005.
ML3 Scientific; SpectrumXTM Ultrathin X-Ray Windows; as accessed on May. 26, 2011; 3 pages.

RESISTIVELY HEATED SMALL PLANAR FILAMENT

CLAIM OF PRIORITY

This is a continuation-in-part of U.S. patent application Ser. No. 12/407,457, filed on Mar. 19, 2009, which is hereby incorporated herein by reference in its entirety.

BACKGROUND

Filaments are used to produce light and electrons. For example, in an x-ray tube, an alternating current can heat a wire filament formed in a coiled cylindrical or helical loop. Due to the high temperature of the filament, and due to a large bias voltage between the filament and an anode, electrons are emitted from the filament and accelerated towards the anode. These electrons form an electron beam. The location where the electron beam impinges on the anode is called the "electron spot." It can be desirable that this spot be circular with a very small diameter. It can be desirable that this spot be in the same location on the anode in every x-ray tube that is manufactured.

The shape and placement of the filament in the x-ray tube affects the shape of the spot. Some filaments are very small, especially in portable x-ray tubes. Placing such small filaments, in precisely the same location, in every x-ray tube, can be a significant manufacturing challenge. Lack of precision of filament placement during manufacturing can result in an electron spot that is in different locations on the anode in different x-ray tubes. Placement of the filament also affects spot size and shape. Lack of precision of filament placement also results in non-circular spots and spots that are larger than desirable.

Shown in FIGS. 13-14 is a coiled cylindrical or helical wire filament 130. As this filament 130 heats and cools, the filament 130 can bend and change its shape, as shown in FIG. 14. As the filament changes shape, the electron spot can change both location and size. This can result in variability of x-ray tube performance over time. It is important that the shape and material of the filament allow for long filament life without filament deformation. Also, the coiled cylindrical or helical shape of the filament can result in non-circular electron spots.

In addition, a filament wire, with a consistent wire diameter, can be hottest at the mid-point 131 along the length of the wire. If there is a consistent wire diameter, the voltage drop or power loss is consistent along the wire, resulting in the same heat generation rate along the wire. The connections at the ends of the wire 132, however, essentially form a heat sink, allowing more heat dissipation, and cooler temperatures, at the each end of the wire. The mid-point of the wire 131 loses less heat by conduction than the wire ends and can be the hottest location on the filament wire. This high heat at the mid-point 131 can result in more rapid deterioration at the wire mid-point 131. As this mid-point 131 deteriorates, its diameter decreases, resulting in a larger power loss, higher temperatures, and an even greater rate of deterioration at this location. Due to the higher temperatures and more rapid wire deterioration at the mid-point 131 of the filament wire, most failures occur at this location. Such failures result in decreased tube life and decreased x-ray tube reliability.

SUMMARY OF THE INVENTION

It has been recognized that it would be advantageous to provide a filament which is easier to handle during manufacturing, resulting in more precise and repeatable placement of the filament. Increased precision of filament placement results in less performance variability between devices using these filaments. In addition, it has been recognized that it would be advantageous to provide a filament that maintains its shape during use and which is less susceptible to filament failures. In addition, it has been recognized that it would be advantageous to provide a smaller and more circular electron spot size in an x-ray tube. This smaller and more circular spot size can be in part the result of a filament which is manufactured and placed with high precision and a filament with a planar, rather than a helical shape.

In one embodiment, the present invention is directed to an electron emitter comprising a pair of spaced-apart bonding pads configured to receive an electrical connection and an elongated planar filament extending between the pair of bonding pads in a planar layer, the planar filament configured to receive an applied electric current therethrough. The planar filament is substantially flat with planar top and bottom surfaces. The planar filament has a length and a width in the planar layer transverse to the length. The planar filament winds in an arcuate path in the planar layer between the pair of bonding pads defining a central spiral segment with the planar filament forming at least one complete revolution about an axis at a center of the planar filament, on either side of the axis, the planar filament forming a double spiral shape oriented parallel to the layer and a pair of serpentine segments on different opposite sides of the spiral segment with each serpentine segment including at least one change in direction. The planar filament is continuous and uninterrupted across the width along an entire length of the planar filament and defines a single current path along the length between the pair of bonding pads. The planar filament has a non-uniform width measured in a plane of the layer and transverse to a length of the planar filament, including a wider, intermediate portion having a wider width that is greater than narrower portions on opposite ends of the intermediate portion, the wider width being at least twice as wide as the narrower portions, and the wider portion is disposed substantially at the axis at the center of the planar filament. This planar design allows for improved electron beam shaping. The double spiral-serpentine shape allows for improved strength and stability. The uninterrupted width, and the wider intermediate portion, allow for increased filament strength and increased lifetime.

In another embodiment, the present invention is directed to a filament device comprising a pair of spaced-apart bonding pads configured to receive an electrical connection and an elongated planar filament extending between the pair of bonding pads in a planar layer. The planar filament is substantially flat with planar top and bottom surfaces. The planar filament has a length and a width in the planar layer transverse to the length. The planar filament is continuous and uninterrupted, across the width along an entire length of the planar filament and defining a single current path along the length between the pair of bonding pads. An intermediate portion of the planar filament has a wider width that is greater than narrower portions on opposite ends of the intermediate portion, the wider width is at least two times wider than narrower portions. This planar design allows for improved electron beam, or electromagnetic radiation, shaping. The uninterrupted width, and the wider intermediate portion, allow for increased filament strength and increased filament lifetime.

In another embodiment, the present invention is directed to a filament device comprising a pair of spaced-apart bonding pads configured to receive an electrical connection and an elongated planar filament extending between the pair of bonding pads in a planar layer. The planar filament is substantially flat with planar top and bottom surfaces. The planar filament has a length and a width in the planar layer transverse to the length. The planar filament winds in an arcuate path in the planar layer between the pair of bonding pads defining a central spiral segment with the planar filament forming at least one complete revolution about an axis at a center of the planar filament, on either side of the axis, the planar filament forming a double spiral shape oriented parallel to the layer and a pair of serpentine segments on different opposite sides of the spiral segment with each serpentine segment including at least one change in direction. This planar design allows for improved electron beam, or electromagnetic radiation, shaping. The double spiral-serpentine shape allows for improved strength and stability.

In one embodiment, the above various planar filaments or electron emitters can be disposed on a support base. The support base can allow for easier and more repeatable placement onto a cathode of an x-ray tube.

DEFINITIONS

Figure 1:
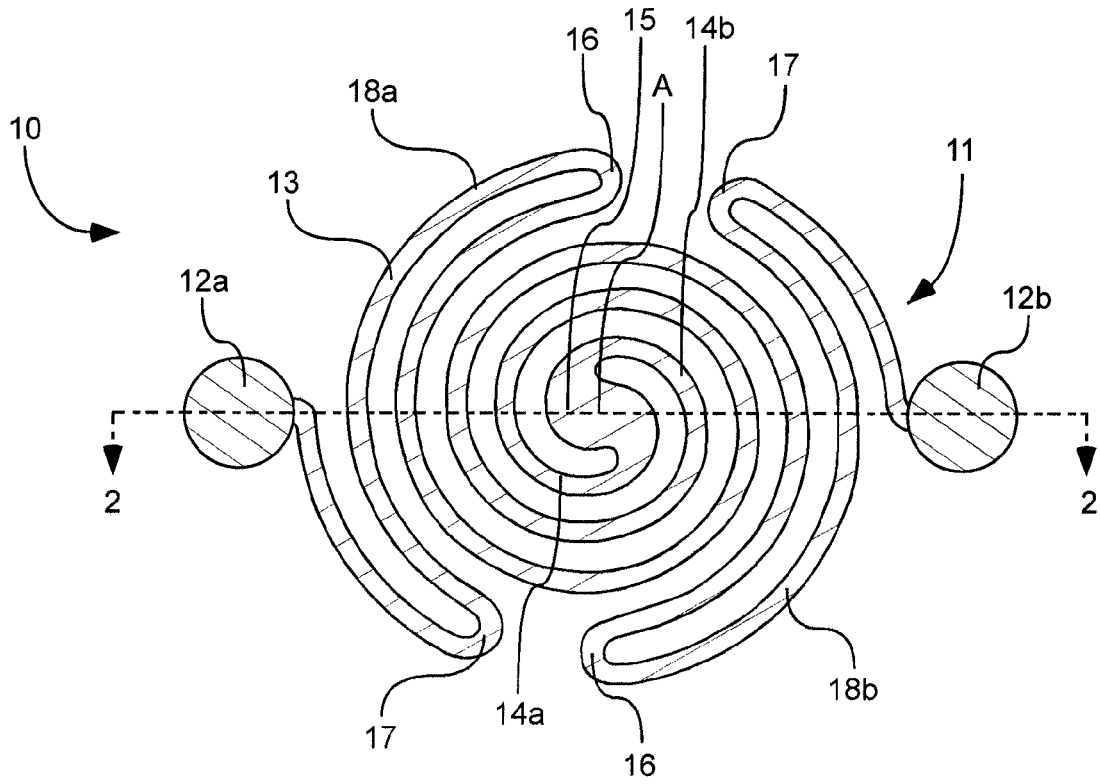
FIG. 1 is a top view of an electron emitter or filament device, in accordance with an embodiment of the present invention.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
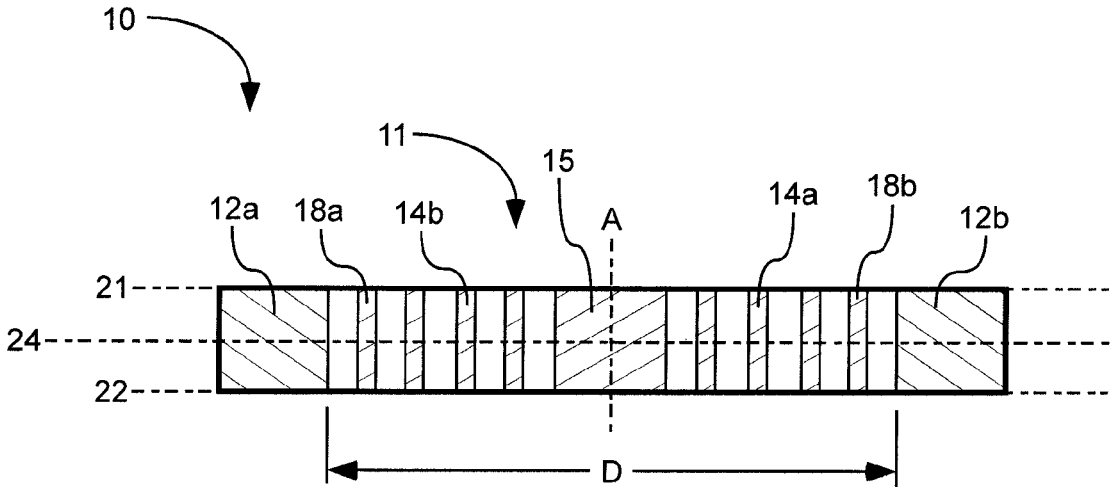
FIG. 2 is a cross-sectional side view of the electron emitter or filament device of FIG. 1 taken along line 2-2 in FIG. 1, in accordance with an embodiment of the present invention.
Figure 3:
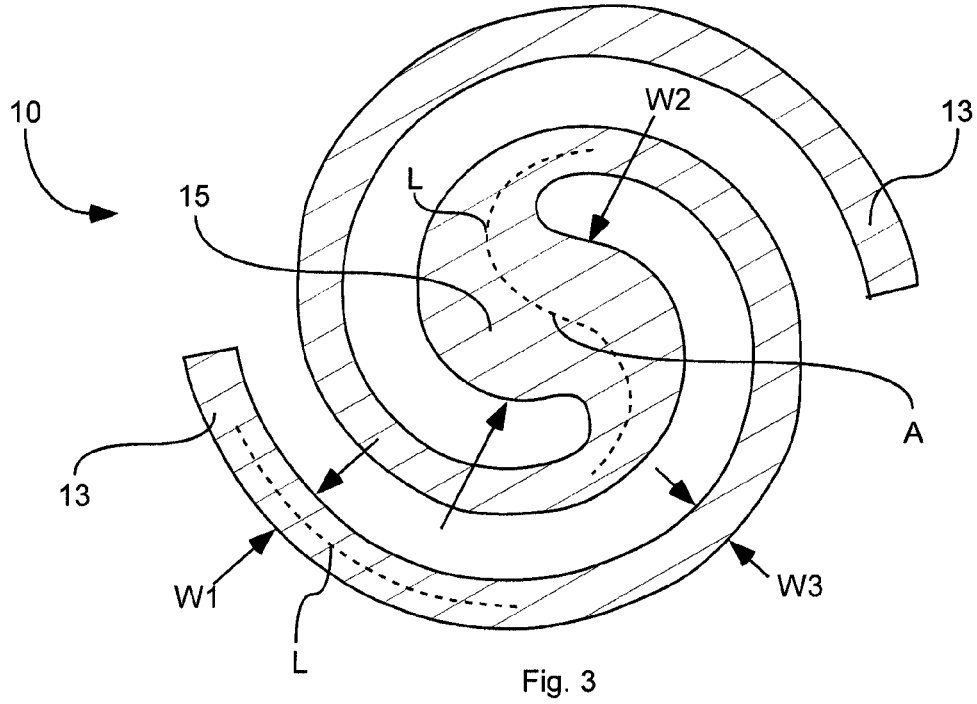
FIG. 3 is a top view of an electron emitter or filament device, in accordance with an embodiment of the present invention.

As shown in FIGS. 1-3, an electron emitter or filament device 10 is shown comprising a pair of spaced-apart bonding pads 12*a-b* and an elongated planar filament 11 extending between the pair of bonding pads 12*a-b* in a planar layer. The bonding pads 12*a-b* are configured to receive an electrical connection, such as being made of a shape and material that will allow for an electrical connection. The planar filament 11 is also configured to receive an applied electric current therethrough. Thus, a first voltage may be applied to one bonding pad 12*a*, and a second, different voltage may be applied to the other bonding pad 12*b*, allowing an electrical current to flow through the filament 11. The bonding pads 12*a-b* and/or planar filament 11 may be formed by patterning as described later.

The planar filament 11 can be sized and shaped to heat or otherwise emit electrons. The planar filament 11 can include a material that is electrically conductive and configured to heat and emit radiation or electrons. For example, refractory materials such as tungsten containing materials, hexaboride compounds, or hafnium carbide may be used as planar filament materials. The bonding pads 12 may be made of the same material as the planar filament or may be a separate material. The bonding pads 12*a-b* and/or planar filament 11 may be formed by patterning as described later.

The filament 11 can be planar, or substantially flat, in a planar layer 24 with a flat top 21 and a flat bottom 22, such that the top and bottom are substantially parallel. The planar filament can have a length L and a width w in the planar layer transverse to the length.

The planar filament 11 can extend non-linearly between the pair of bonding pads 12*a* and 12*b* so that the planar filament has a length (if stretched linearly) longer than a distance between the bonding pads 12. In one embodiment, the planar filament 11 can include an arcuate, or curved, path in the planar layer between the pair of bonding pads 12. The curved path can include a central spiral segment 14*a-b* with the filament forming at least one complete revolution about an axis A at a center of the filament, on either side of the axis A. Thus, the planar filament 11 can form a double spiral shape 14*a-b* oriented parallel to the layer.

Figure 4:
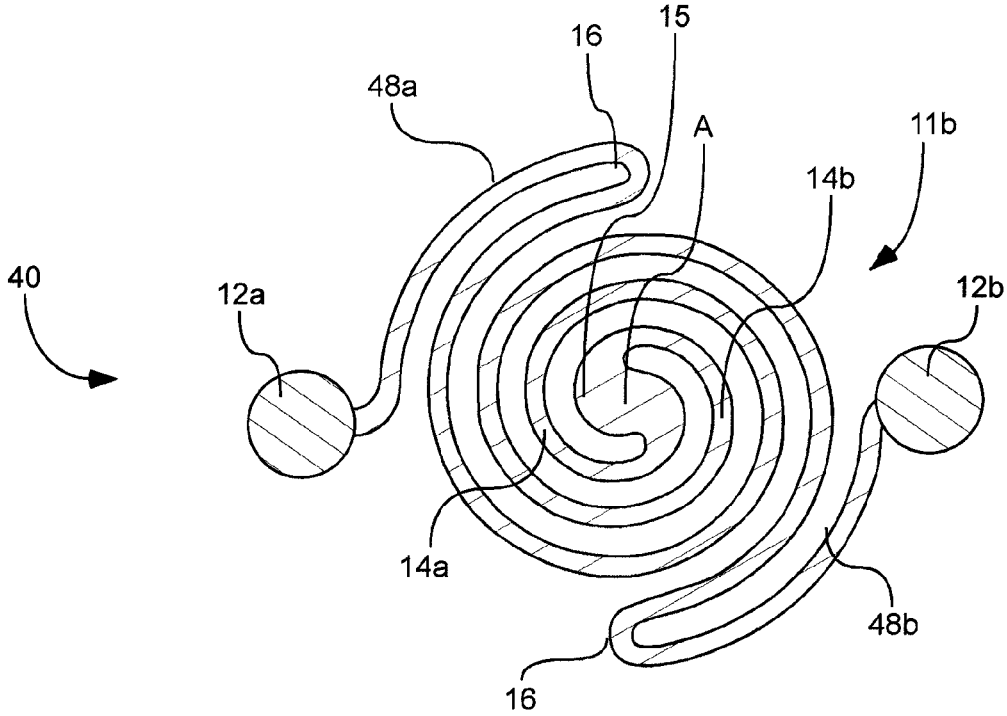
FIG. 4 is a top view of an electron emitter or filament device, in accordance with an embodiment of the present invention.

In another embodiment, the planar filament 11 can include a pair of serpentine segments 18*a-b* on different opposite sides of the spiral segment 14*a-b* with each serpentine segment including at least one change in direction 16. In one embodiment, each serpentine segment can include at least two changes in direction 16 & 17 and can form at least two incomplete revolutions about the axis A in opposite directions. Shown in FIG. 4 is a filament 40 embodiment with planar filament 11*b* that has only one change in direction of direction 16 in serpentine segments 48*a-b* on different opposite sides of the spiral segment 14*a-b*. Choice of the number of changes of direction for the serpentine segment 18 or 48 depends on desired strength, space constraints, length of each serpentine segment, and planar filament material of construction. This spiral-serpentine shape can provide for improved structural support for the planar filament 11. The spiral only shape may be preferable in some situations for simplicity of design.

In one embodiment, the planar filament 11 can have a non-uniform width W measured in a plane of the layer, or parallel with the layer, and transverse to a length L of the filament. The planar filament 11 can include a wider, intermediate portion 15 having a wider width W2 that is greater than a width W1 and W3 of narrower portions 13 on opposite ends of the intermediate portion 15. This wider, intermediate portion 15, and portions of narrower section 13 is shown in FIG. 1 and FIG. 4, but is also shown magnified in FIG. 3. In one embodiment, the wider width W2, of the intermediate portion 15, is at least 50% wider than the width W1 of the narrower portions 13 (W2−W1/W1>0.50). In another embodiment, the wider width W2, of the intermediate portion 15, is at least twice as wide as the width W1 of the narrower portions 13 (W2/W1>2). In another embodiment, the wider width W2, of the intermediate portion 15, is at least four times as wide as the width W1 of the narrower portions 13 (W2/W1>4). In one embodiment, the wider, intermediate portion 15 is disposed substantially at the axis A at the center of the planar filament 11.

In one embodiment, the planar filament 11 can have a substantially constant width W along a majority of the length L of the planar filament 11 except for the intermediate portion 15. For example, in FIG. 3 is one section of narrower portion with a width W1 and another section of narrower portion with a width W3. These two widths can be substantially equal to each other. In one embodiment, a maximum difference in width within the narrower portions is less than 25% (W1−W3/W1<0.25 and W1>W3). In another embodiment, a maximum difference in width within the narrower portions is less than 10% (W1−W3/W1<0.1 and W1>W3). In another embodiment, a maximum difference in width within the narrower portions is less than 5% and (W1−W2/W1<0.05 and W1>W3). In another embodiment, a maximum difference in width within the narrower portions is less than 1% (W1−W3/W1<0.01 and W1>W3).

A wider, intermediate portion 15 can have less voltage drop than the narrower portions 13, due to the wider width W2. This can result in less heat generated at the wider, intermediate portion 15 than if this intermediate portion was narrower. Narrower portions 13 nearer to the bond pads 12 can lose more heat due to conduction heat transfer into the bond pads 12 and surrounding materials. Therefore, having a wider, intermediate portion 15 can result in a more uniform temperature distribution across the planar filament 11. This more uniform temperature distribution can result in lower temperatures at the central, intermediate portion 15, and thus longer filament life than if the filament were all the same width or diameter. More uniform temperature distribution can also result in more even electron emission along the length of the planar filament and improved electron spot shape. The wider width of the intermediate portion 15 can also help to extend the life of the filament due to its increased size.

In one embodiment, the planar filament 11 is very small, and has a diameter D of less than 10 millimeters (diameter D is defined in FIG. 2). In another embodiment, the planar filament 11 has a diameter D of less than 2 millimeters. In one embodiment, the planar filament has a minimum width W of less than 100 micrometers. In another embodiment, the planar filament has a minimum width W of less than 50 micrometers.

Figure 15:
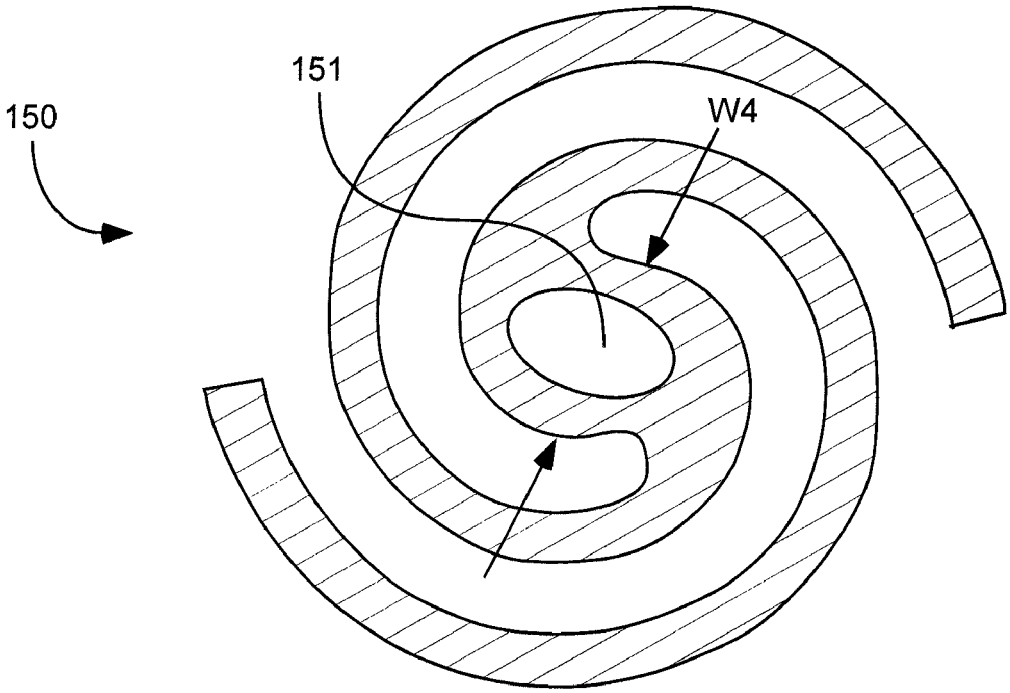
Fig. 15 Prior Art
FIG. 15 is a top view of a prior art planar filament.

In one embodiment, for improved strength and increased life of the planar filament 11, the planar filament 11 can be continuous and uninterrupted across the width W along an entire length L of the filament and can define a single current path along the length L between the pair of bonding pads 12. A continuous and uninterrupted width W can allow for increased filament life. In contrast, prior art filament 150 shown in FIG. 15 has an opening 151 in the filament, thus providing a dual current path and a discontinuity or interruption in the width W4. See U.S. Pat. No. 5,343,112.

Figure 5:
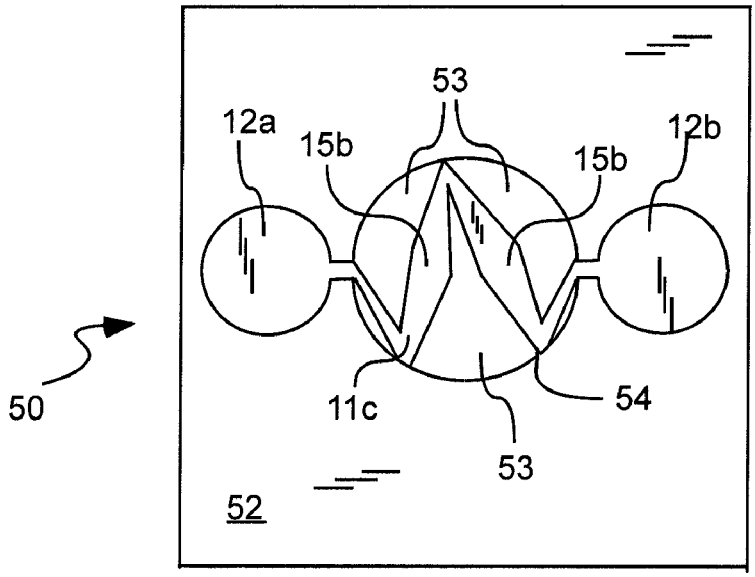
FIG. 5 is a top view of an electron emitter or filament device, in accordance with an embodiment of the present invention.

In one embodiment of the present invention, the planar filament does not have a spiral shape. For example, as shown in FIG. 5, a filament 50 can include a planar filament 11*c* that has a zig-zag or serpentine shape. In one embodiment, bonding pads 12*a-b* of the planar filament 50 can be disposed on an electrically insulative substrate 52. In one embodiment, intermediate portions 54 of the planar filament 11*c* can contact and be carried by the substrate 52. In addition, the planar filament 11*c* can have increased width at intermediate portions 15*b* (between the ends where the filament touches the substrate).

Figure 6:
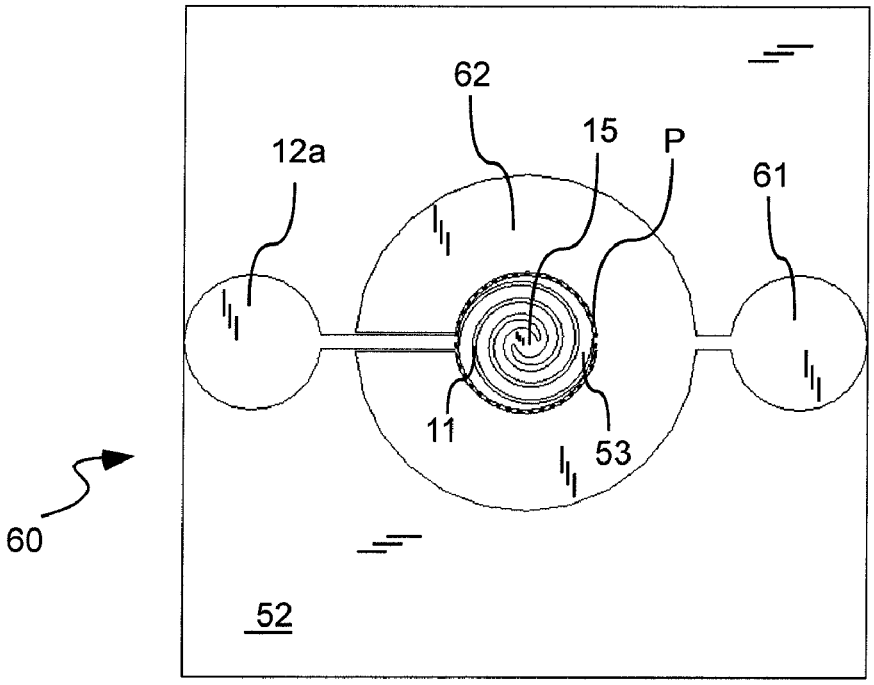
FIG. 6 is a top view of an electron emitter or filament device, and a beam shaping pad, in accordance with an embodiment of the present invention.
Figure 7:
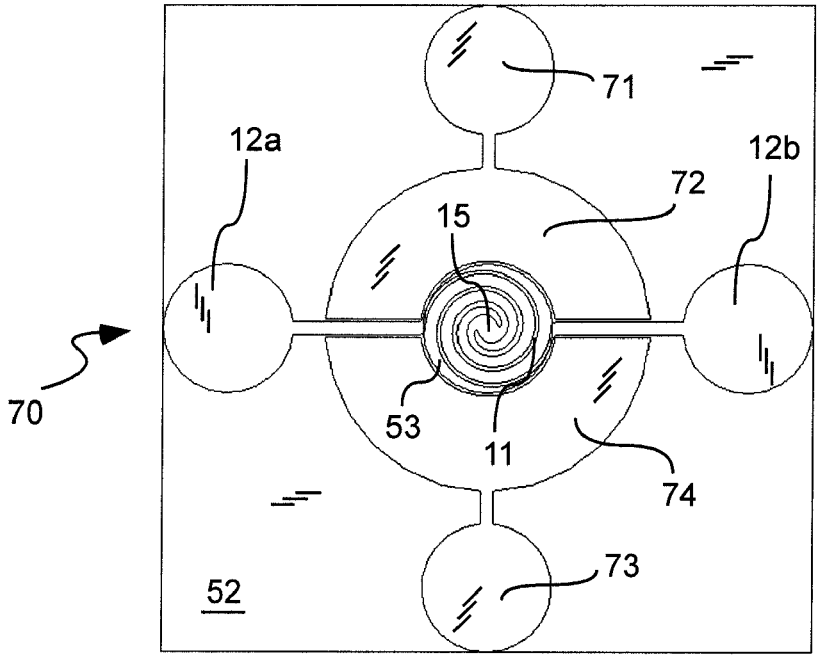
FIG. 7 is a top view of an electron emitter or filament device, and multiple beam shaping pads, in accordance with an embodiment of the present invention.
Figure 8:
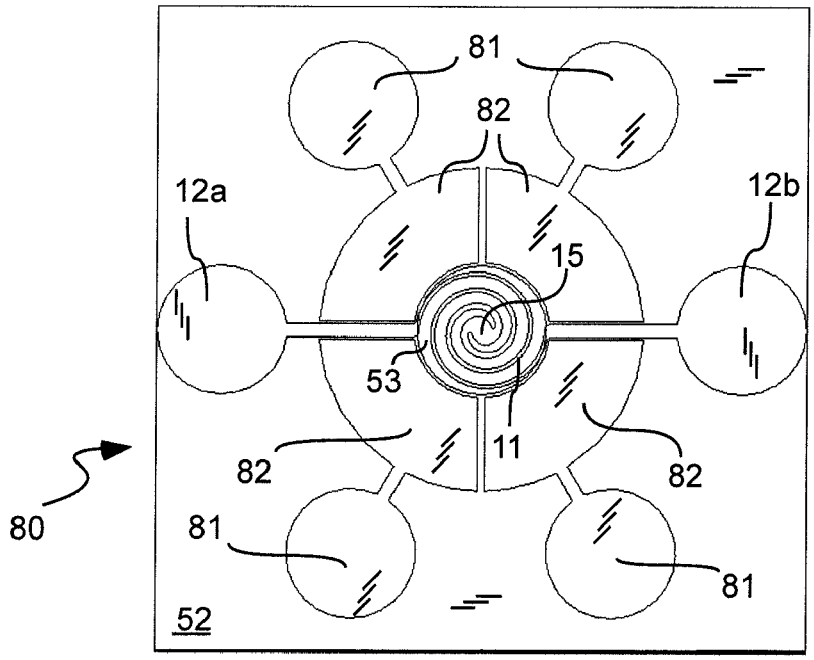
FIG. 8 is a top view of an electron emitter or filament device, and multiple beam shaping pads, in accordance with an embodiment of the present invention.

As shown in FIGS. 6-8, electron emitter or filament device 60-80 can include at least one beam shaping pad. The beam shaping pad(s) can be defined by the layer 24 of the planar filament 11, and disposed adjacent to and spaced-apart from the planar filament 11. Beam shaping pads can be patterned with the planar filament 11 and/or bonding pads 12. Beam shaping pads can affect the shape of the electron beam or electromagnetic radiation and/or can aid in improving or directing the shape and location of the electron spot. The discussion of beam shaping pads, and planar filaments shown in FIGS. 6-8 is applicable to all planar filament embodiments described herein.

As shown in FIG. 6, a single beam shaping pad 62 can surround most of the planar filament 11. In one embodiment, the single beam shaping pad 62 can surround at least 75% of an outer perimeter P of the planar filament. In another embodiment, the single beam shaping pad 62 can surround at least 90% of an outer perimeter P of the planar filament. The single beam shaping pad 62 can be electrically connected to, and can be at approximately the same voltage as one of the bonding pads 61.

As shown in FIG. 7, an electron emitter or filament device 70 can include two beam shaping pads 72 and 74 with their own bonding pads 71 and 73 separate from the bonding pads 12*a* and 12*b* of the planar filament 11. The beam shaping pads 72 and 74 can be located on opposite sides of the planar filament and between the bonding pads 12*a* and 12*b* of the planar filament. These two beam shaping pads 72 and 74 can both be at the same potential or one can be different from the other. They can both be at a more negative or more positive potential than either of bonding pads 12*a* and 12*b* of the planar filament, or they could be the same potential as one of the bonding pads of the planar filament. At least one of the beam shaping pads could be an electrical potential that is more positive than one of the bonding pads of the planar filament, and more negative than another bonding pad of the planar filament. One of the beam shaping pads could be more positive than the bonding pads 12*a* and 12*b* of the planar filament, and the other beam shaping pad more negative than the bonding pads 12*a* and 12*b* of the planar filament. A more positive beam shaping pad potential can result in the electron beam being directed away from that side. A more negative beam shaping pad potential can result in the electron beam being drawn towards that side. Use of beam shaping pads can result in improved control of electron spot location, size, and shape.

As shown in FIG. 8, an electron emitter or filament device 80 includes multiple (such as four) beam shaping pads 82. Each beam shaping pad 82 can be connected to a bonding pad 81. Although not shown in any drawing, there could be three or there could be five or more beam shaping pads, depending on the desired effect on the electron beam. The beam shaping pads could also be many different shapes, different from the shapes shown in the drawings.

Figure 9:
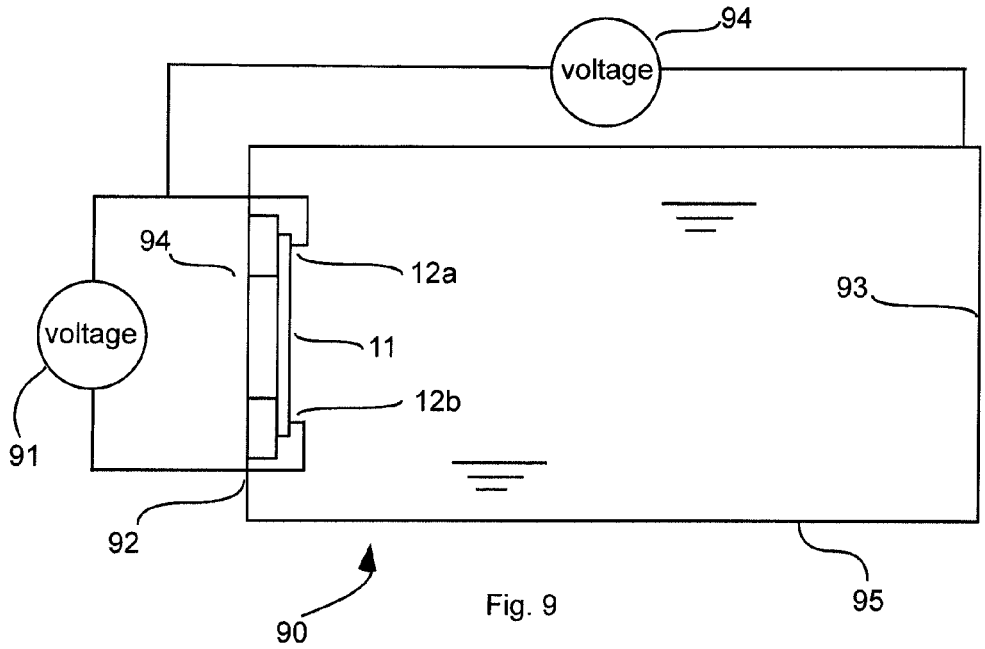
FIG. 9 is a schematic cross-sectional side view of an x-ray tube, including an electron emitter or filament device, in accordance with an embodiment of the present invention.

As shown in FIG. 9, an x-ray tube 90 is shown utilizing an electron emitter or filament device 94, according to one of the embodiments described herein, including a planar filament 11. The x-ray tube 90 can include a vacuum tube or vacuum enclosure 95 including opposing cathode 92 and anode 93. The planar filament 11 can be adhered to the cathode 92. Electrical connections can be made to the bonding pads 12*a* and 12*b* to allow an electrical current to flow through the planar filament 11 from a power source 91. The planar filament 11 can be a large negative bias voltage compared to the anode 93. The large negative bias voltage can be supplied by a high voltage power supply 94. The electrical current in the planar filament 11 can heat the planar filament, resulting in electron emission from the planar filament 11. The large bias voltage between the anode 93 and the planar filament 11 can result in an electron beam from the planar filament to the anode 93. Due to the planar shape of the filament in the present invention, the electron spot on the anode 93 can be smaller and more circular than with helical filaments. A planar filament with a substrate 52 or support structure can be more easily placed in the same location in each x-ray tube that is manufactured, resulting in less manufacturing variation. Various aspects of x-ray tubes are shown and described in U.S. Pat. No. 7,382,862; and U.S. patent application Ser. No. 11/879,970, filed Jul. 18, 2007; which are herein incorporated by reference.

Figure 10:
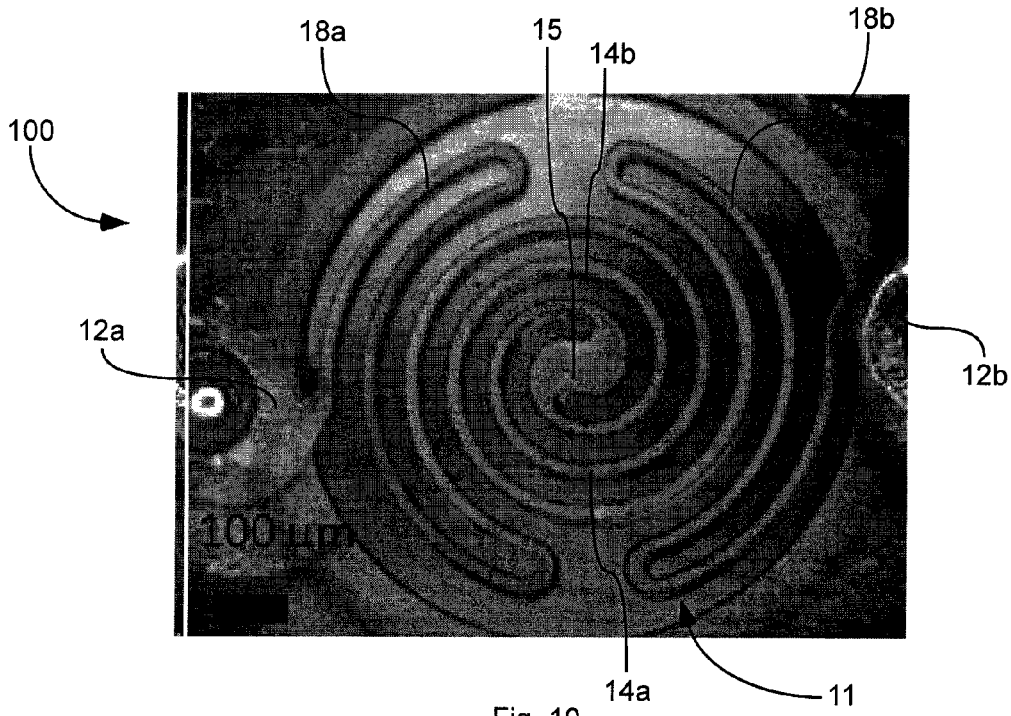
FIG. 10 is a photograph showing a top view of an electron emitter or filament device, in accordance with an embodiment of the present invention.

FIG. 10 shows a photograph of an electron emitter or filament device 100 including a planar filament 11. The planar filament 11 includes central spiral shaped sections 14*a-b*, a wider, intermediate section 15, and outer, serpentine sections 18*a-b*. It also includes bonding pads 12*a-b*.

Although the present invention has been described above and illustrated with bonding pads 12 that are large relative to the planar filament 11, it will be appreciated that the bonding pads 12 can be smaller, and/or can be configured for any type of electrical connection to the power source. Bonding pads 12 can include a post, a pad, or any other device configured to allow for an electrical connection in order to allow an electrical current to flow through the planar filament 11.

How to Make:

The filament 11, bond pads 12*a-b*, and/or beam shaping pads can be a thin film material. To avoid handling damage to this thin film material during filament manufacturing and placement, the planar filament can be connected to a type of support structure. A support structure which electrically isolates one bond pad 12*a* from the other bond pad 12*b* can be used to allow an electrical current to flow from one bond pad to the other through the planar filament 11. The support structure can be situated such that it does not touch the planar filament 11. This may be desirable in order to avoid conductive heat transfer from the planar filament 11 to the support structure.

Figure 11:
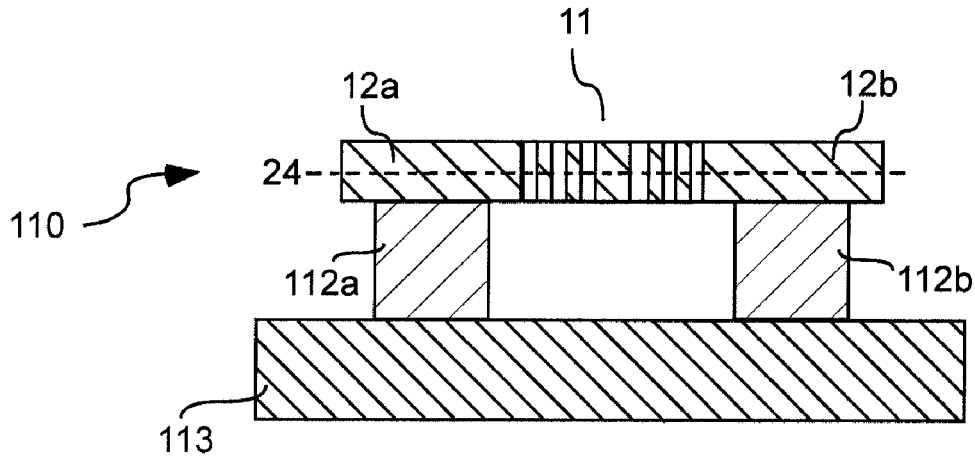
FIG. 11 is a schematic cross-sectional side view of an electron emitter or filament device, in accordance with an embodiment of the present invention.

For example, electron emitter or filament device 110 in FIG. 11 can be supported by electrically isolated support structures 112*a* and 112*b*. An electrical connection can be made directly to the bond pads 12*a* and 12*b*, with a different electrical potential on one bond pad 12*a* than on the other bond pad 12*b*, thus allowing an electrical current to flow through the planar filament 11. Alternatively, if the support structures 112*a* and 112*b* are electrically conductive, an electrical connection can be made to the support structures, with a different electrical potential on one support structure 112*a* than on the other support structure 112*b*, thus allowing an electrical current to flow through the planar filament 11. The support structures can be a shape that allows easy placement into the equipment where the planar filament will be used.

The support structures 112*a-b* can be attached to a support base 113 for additional structural strength and to aid in handling and placement of the planar filament 11. This support base 113 can have high electrical resistance in order to electrically isolate one support structure 112 and thus also one bond pad 12 from the other. The support structures 112 can be mounted onto the support base 113 with an adhesive, by pushing the support structures 112 into holes in the support base 113, with fasteners such as screws, or other appropriate fastening method.

A laser can be used to cut the layer 24 to create the planar filament 11 and bond pad 12 shapes. Alternately, the planar filament 11 and bond pad 12 shapes can be made by photolithography techniques. The layer 24 can be coated with photoresist, exposed to create the desired pattern, then etched. These methods of making the planar filament 11 and bond pad 12*a* and 12*b* shapes apply to all embodiments of the filament device discussed in this application. These methods also apply to making the beam shaping pads. Forming the planar filament 11 and bond pad 12 structure through laser machining or forming the filament and bond pad structure through photolithography techniques may be referred to herein as "patterned" or "patterning".

The layer 24 can be laser or spot welded onto the support structures 112*a* and 112*b*. The support structures 112*a* and 112*b* can hold the layer 24 in place while cutting out the planar filament 11 and bond pads 12*a* and 12*b* as discussed previously. Alternatively, the bond pads 12*a* and 12*b* can be laser welded onto the support structures 22*a* and 22*b* after the bond pads 12*a* and 12*b* and filament 11 have been cut.

Figure 12:
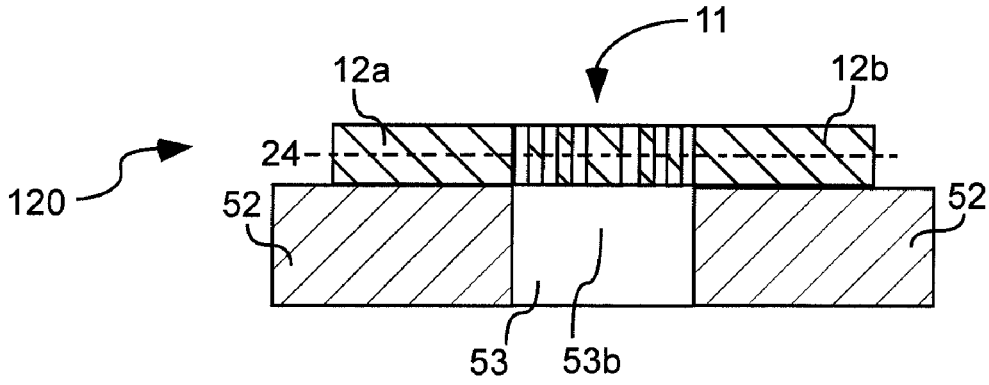
FIG. 12 is a schematic cross-sectional side view of an electron emitter or filament device, in accordance with an embodiment of the present invention.
Figure 13:
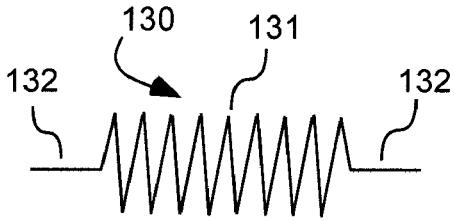
Fig. 13 Prior Art
FIG. 13 is a side view of a prior art helical filament.
Figure 14:
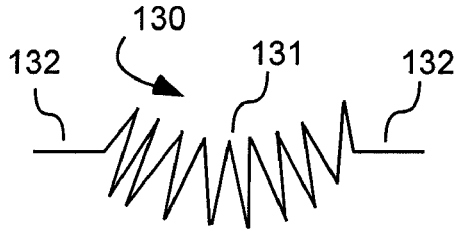
Fig. 14 Prior Art
FIG. 14 is a side view of a prior art helical filament.

An alternative method is shown in FIG. 12. The electron emitter or filament device 120 can be made by attaching, such as by brazing or laser welding, planar layer 24 onto a substrate 52. The substrate 52 can be a heat resistive, electrically insulating material, such as alumina or silicon. The substrate 52 can aid in handling the planar filament without damage and placing it consistently in the desired equipment location.

A space 53 can be disposed between the planar filament 11 and the substrate 52 such that a substantial portion of the filament, such as all or a majority of the planar filament 11, is suspended above the substrate 52 by the pair of boding pads 12. The space 53 beneath the planar filament 11 can be an open area such as a vacuum, air, or other gas. The substrate 52 can be wholly or partially removed beneath the filament forming a recess or cavity 53*b* bounded by the substrate on the sides (and possibly the bottom) with the planar filament 11 on top. High filament temperatures are normally needed for electron emission in an x-ray tube. To avoid conductive heat transfer away from the planar filament, it can be beneficial to remove the substrate 52 beneath most or all of the filament area.

To make a planar filament with a substrate 52, such as the filament device 120 shown in FIG. 12, a layer 24 can be brazed onto a substrate 52. Prior to brazing the layer 24, a cavity or hole 53*b* can be cut in the substrate 52. With the layer 24 held securely in place by the substrate 52, the bond pad 12 and planar filament 11 shapes can be cut out by laser machining or patterning and etching as described previously.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. An electron emitter device comprising:

a. a pair of spaced-apart bonding pads configured to receive an electrical connection;

b. an elongated planar filament extending between the pair of bonding pads in a planar layer, the planar filament configured to receive an applied electric current therethrough;

c. the planar filament being substantially flat with planar top and bottom surfaces;

d. the planar filament having a length and a width in the planar layer transverse to the length; and e. the planar filament winding in an arcuate path in the planar layer between the pair of bonding pads defining:

i. a central spiral segment with the planar filament forming at least one complete revolution about an axis at a center of the planar filament, on either side of the axis, the planar filament forming a double spiral shape oriented parallel to the layer, and ii. a pair of serpentine segments on different opposite sides of the spiral segment with each serpentine segment including at least one change in direction;

f. the planar filament being continuous and uninterrupted across the width along an entire length of the planar filament and defining a single current path along the length between the pair of bonding pads;

g. the planar filament having a non-uniform width measured in a plane of the layer and transverse to a length of the planar filament; and h. the planar filament including a wider, intermediate portion having a wider width that is greater than narrower portions on opposite ends of the intermediate portion, the wider width being at least twice as wide as the narrower portions, and the wider portion being disposed substantially at the axis at the center of the planar filament.

2. The device of claim 1, wherein a minimum width of the planar filament is less than 100 micrometers.

3. The device of claim 1, wherein the wider width of the intermediate portion is at least four times as wide as the narrower portions.

4. The device of claim 1, wherein each serpentine segment:

a. includes at least two changes in direction, and b. forms at least two incomplete revolutions about the axis in opposite directions.

5. The device of in claim 1, further comprising at least one beam shaping pad also defined by the layer, and disposed adjacent to and spaced-apart from the planar filament.

6. The device of claim 1, wherein the planar filament has a substantially constant width along a majority of the length of the planar filament except for the intermediate portion.

7. A filament device comprising:

a. a pair of spaced-apart bonding pads configured to receive an electrical connection;

b. an elongated planar filament extending between the pair of bonding pads in a planar layer;

c. the planar filament being substantially flat with planar top and bottom surfaces;

d. the planar filament having a length and a width in the planar layer transverse to the length;

e. the planar filament being continuous and uninterrupted, across the width along an entire length of the planar filament and defining a single current path along the length between the pair of bonding pads; and f. an intermediate portion of the planar filament having a wider width that is greater than narrower portions on opposite ends of the intermediate portion, the wider width being at least two times wider than narrower portions.

8. The device of claim 7, wherein the planar filament has a substantially constant width along a majority of the length of the planar filament except for the intermediate portion.

9. The device of in claim 7, further comprising:

a. a vacuum enclosure disposed about the planar filament;

b. a cathode coupled to the vacuum enclosure and the planar filament;

c. an anode coupled to the vacuum enclosure and opposing the cathode; and d. a power source electrically coupled to the pair of bonding pads to apply the electric current through the planar filament to cause the planar filament to release electrons, and a high voltage power supply being electrically coupled to the cathode and the anode to form a voltage differential therebetween to cause the electrons to accelerate to the anode.

10. The device of claim 7, wherein:

a. the planar filament winds in an arcuate in the planar layer between the pair of bonding pads defining a center spiral segment with the planar filament forming at least one complete revolution about an axis at a center of the planar filament, on either side of the axis, the planar filament forming a double spiral shape oriented parallel to the layer; and b. the intermediate portion is disposed substantially at the axis at the center of the planar filament.

11. The device of claim 10, wherein the planar filament includes a pair of serpentine segments on different opposite sides of the spiral segment in which each serpentine segment extends in a first direction about an axis and doubles-back in a second direction about the axis defining a serpentine path.

12. The device of claim 11, wherein each serpentine segment:

a. includes at least two changes in direction, and b. forms at least two incomplete revolutions about the axis in opposite directions.

13. The device of in claim 7, further comprising at least one beam shaping pad also defined by the layer, and disposed adjacent to and spaced-apart from the planar filament.

14. The device of claim 7, wherein a minimum width of the planar filament is less than 50 micrometers.

15. A filament device comprising:

a. a pair of spaced-apart bonding pads configured to receive an electrical connection;

b. an elongated planar filament extending between the pair of bonding pads in a planar layer;

c. the planar filament being substantially flat with planar top and bottom surfaces;

d. the planar filament having a length and a width in the planar layer transverse to the length; and e. the planar filament winding in an arcuate path in the planar layer between the pair of bonding pads defining:

i. a center spiral segment with the planar filament forming at least one complete revolution about an axis at a center of the planar filament, on either side of the axis, the planar filament forming a double spiral shape oriented parallel to the layer, and ii. a pair of serpentine segments on different opposite sides of the spiral segment with each serpentine segment including at least one change in direction.

16. The device of claim 15, wherein a. the planar filament is continuous and uninterrupted, across the width along an entire length of the planar filament and defines a single current path along the length between the pair of bonding pads;

b. an intermediate portion of the planar filament has a wider width that is greater than narrower portions on opposite ends of the intermediate portion, the wider width being at least 50% wider than narrower portions; and c. the planar filament has a substantially constant width along a majority of the length of the planar filament except for the intermediate portion.

17. The device of claim 15, further comprising the planar filament being continuous and uninterrupted across the width along an entire length of the planar filament and defining a single current path along the length between the pair of bonding pads.

18. The device of claim 15, further comprising an intermediate portion of the planar filament having a wider width greater than narrower portions on opposite ends of the intermediate portion, the wider width of the intermediate portion being at least 50% wider than narrower portions.

19. The device of in claim 15, further comprising at least one beam shaping pad also defined by the layer, and disposed adjacent to and spaced-apart from the planar filament.

20. The device of in claim 15, further comprising:

a. a vacuum enclosure disposed about the planar filament;

b. a cathode coupled to the vacuum enclosure and the planar filament;

c. an anode coupled to the vacuum enclosure and opposing the cathode; and d. a power source electrically coupled to the pair of bonding pads to apply the electric current through the planar filament to cause the planar filament to release electrons, and a high voltage power supply being electrically coupled to the cathode and the anode to form a voltage differential therebetween to cause the electrons to accelerate to the anode.

* * * * *

UNITED STATES PATENT AND TRADEMARK OFFICE

CERTIFICATE OF CORRECTION

PATENT NO. : 8,247,971 B1
APPLICATION NO. : 13/209862
DATED : August 21, 2012
INVENTOR(S) : Bard et al.

It is certified that error appears in the above-identified patent and that said Letters Patent is hereby corrected as shown below:

Title page

Item (75) Inventors: Add --Vern Bangerter--.

Signed and Sealed this
Twenty-ninth Day of March, 2016

Michelle K. Lee

Michelle K. Lee
*Director of the United States Patent and Trademark Office*